US010854398B2

(12) United States Patent
Tanigaki et al.

(10) Patent No.: US 10,854,398 B2
(45) Date of Patent: Dec. 1, 2020

(54) OPERATING DEVICE AND CIRCUIT BREAKER

(71) Applicant: Mitsubishi Electric Corporation, Tokyo (JP)

(72) Inventors: Shuichi Tanigaki, Tokyo (JP); Daisuke Fujita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/322,374

(22) PCT Filed: Aug. 8, 2016

(86) PCT No.: PCT/JP2016/073333

§ 371 (c)(1),
(2) Date: Jan. 31, 2019

(87) PCT Pub. No.: WO2018/029760

PCT Pub. Date: Feb. 15, 2018

(65) Prior Publication Data

US 2019/0198265 A1 Jun. 27, 2019

(51) Int. Cl.
*H01H 1/14* (2006.01)
*H01H 3/30* (2006.01)
(Continued)

(52) U.S. Cl.
CPC ..... *H01H 3/3042* (2013.01); *H01H 1/14* (2013.01); *H01H 3/30* (2013.01); *H01H 3/38* (2013.01); *H01H 33/40* (2013.01); *H01H 33/42* (2013.01)

(58) Field of Classification Search
CPC ..... H01H 1/14; H01H 3/30; H01H 3/3042; H01H 3/38
(Continued)

(56) References Cited

U.S. PATENT DOCUMENTS 2,811,347 A * 10/1957 Cass ..... F16F 1/14 267/277
4,839,476 A 6/1989 Okuno
5,451,731 A * 9/1995 Yoshizumi ..... H01H 33/168 218/143

FOREIGN PATENT DOCUMENTS

GB 783398 A 9/1957
JP S63304542 A 12/1988
JP H10231898 A 9/1998

OTHER PUBLICATIONS

International Search Report (with English translation) and Written Opinion issued in corresponding International Patent Application No. PCT/JP2016/073333, 8 pages (dated Oct. 25, 2016).

* cited by examiner

*Primary Examiner* — William A Bolton
*Assistant Examiner* — Iman Malakooti
(74) *Attorney, Agent, or Firm* — Buchanan Ingersoll & Rooney PC

(57) ABSTRACT

An operating device includes: a lever rotatable about a rotating axis; a first torsion bar extending in a first direction along the rotating axis; a second torsion bar provided inside the first torsion bar, extending along the rotating axis, coupled to the first torsion bar at a portion located farther in the first direction than the lever, and extending from the portion of coupling with the first torsion bar toward a second direction opposite to the first direction beyond the lever; and a third torsion bar surrounding the second torsion bar, having a tubular shape, coupled to the second torsion bar at a portion located farther in the second direction than the lever, and extending from the portion of coupling with the second torsion bar in the first direction.

15 Claims, 10 Drawing Sheets

(51) Int. Cl.
*H01H 33/42* (2006.01)
*H01H 3/38* (2006.01)
*H01H 33/40* (2006.01)

(58) Field of Classification Search
USPC ..... 200/17 R, 400
See application file for complete search history.

OPERATING DEVICE AND CIRCUIT BREAKER

FIELD

The present invention relates to an operating device for opening and closing a contact using the energy stored by twisting of a torsion bar, and to a circuit breaker including the operating device.

BACKGROUND

An operating device for opening and closing a contact of a circuit breaker installed in a substation or a switching station is known to include a torsion bar, as disclosed in Patent Literature 1. Such an operating device performs the opening and closing operation for the contact using the energy stored when the torsion bar is twisted.

CITATION LIST

Patent Literature

Patent Literature 1: Japanese Patent Application Laid-open No. S63-304542

SUMMARY

Technical Problem

The circuit breaker includes a tank containing a contact inside and filled with an insulating gas, and the operating device is attached to an end face of the tank. The torsion bar of the above conventional operating device extends only in one direction from the lever coupled to the contact of the circuit breaker. Therefore, the distance from the lever to the end of the torsion bar is large. Since the lever of the operating device is coupled to the contact, the operating device is provided such that the lever is positioned on the end face of the tank. In this case, since the distance from the lever of the operating device to the end of the torsion bar is large, the protruding area of the torsion bar from the tank is also large, causing the following problem: The circuit breaker needs to be large, and a support structure for supporting the torsion bar is required, resulting in a complicated structure.

The present invention has been made in view of the above, and an object thereof is to provide an operating device capable of shortening the distance from the lever coupled to the contact to the end of the torsion bar.

Solution to Problem

In order to solve the above-mentioned problem and achieve the object, an operating device of the present invention includes: a lever rotatable about a rotating axis; a first torsion bar coupled to the lever, having a tubular shape including the rotating axis as its central axis, and extending in a first direction along the rotating axis; a second torsion bar provided inside the first torsion bar, extending along the rotating axis, coupled to the first torsion bar at a portion located farther in the first direction than the lever, and extending from the portion of coupling with the first torsion bar toward a second direction opposite to the first direction beyond the lever; and a third torsion bar surrounding the second torsion bar, having a tubular shape including the rotating axis as a center, coupled to the second torsion bar at a portion located farther in the second direction than the lever, and extending from the portion of coupling with the second torsion bar in the first direction. Rotation of the third torsion bar is restricted at its end located in the first direction.

Advantageous Effects of Invention

The present invention can achieve the effect of obtaining an operating device capable of shortening the distance from the lever coupled to the contact to the end of the torsion bar.

DESCRIPTION OF EMBODIMENTS

Hereinafter, an operating device and a circuit breaker according to embodiments of the present invention will be described in detail based on the drawings. The present invention is not limited to the embodiments.

First Embodiment

Figure 1:
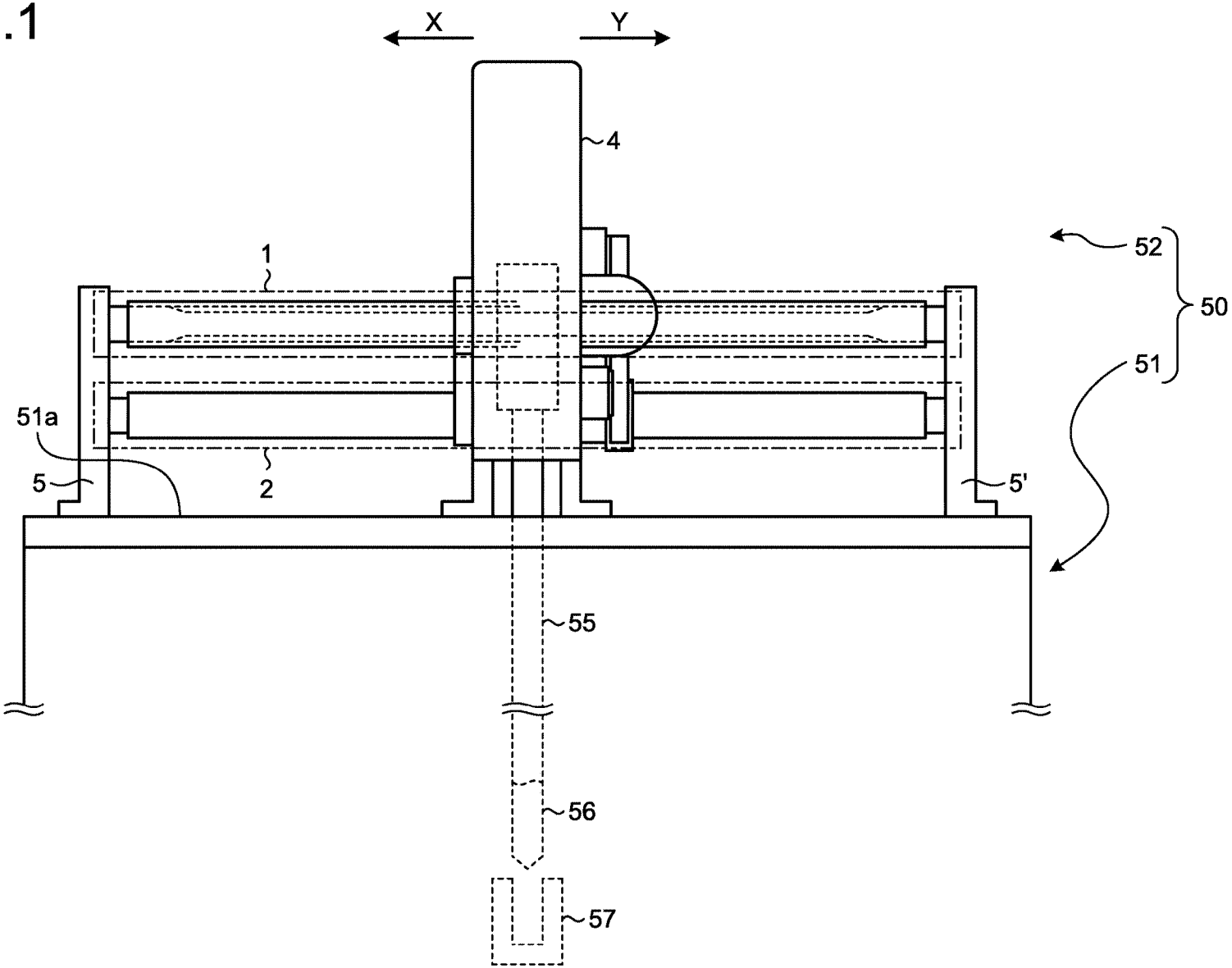
FIG. 1 is an enlarged front view of an operating device of a circuit breaker according to a first embodiment of the present invention.

FIG. 1 is an enlarged front view of an operating device of a circuit breaker according to a first embodiment of the present invention. The circuit breaker 50 includes a tank 51 filled with an insulating gas, and an operating device 52 attached to an end face of the tank 51.

The operating device 52 includes a housing 4 fixed to an end face 51*a* of the tank 51, an opening torsion bar 1 extending to both sides of the housing 4 along a first direction indicated by arrow X and a second direction indicated by arrow Y, a closing torsion bar 2 similarly extending to both sides of the housing 4 along the direction indicated by arrow X and the direction indicated by arrow Y, and a first support 5 and a second support 5' fixed to the end face 51*a* of the tank 51 to support the opening torsion bar 1 and the closing torsion bar 2.

Figure 2:
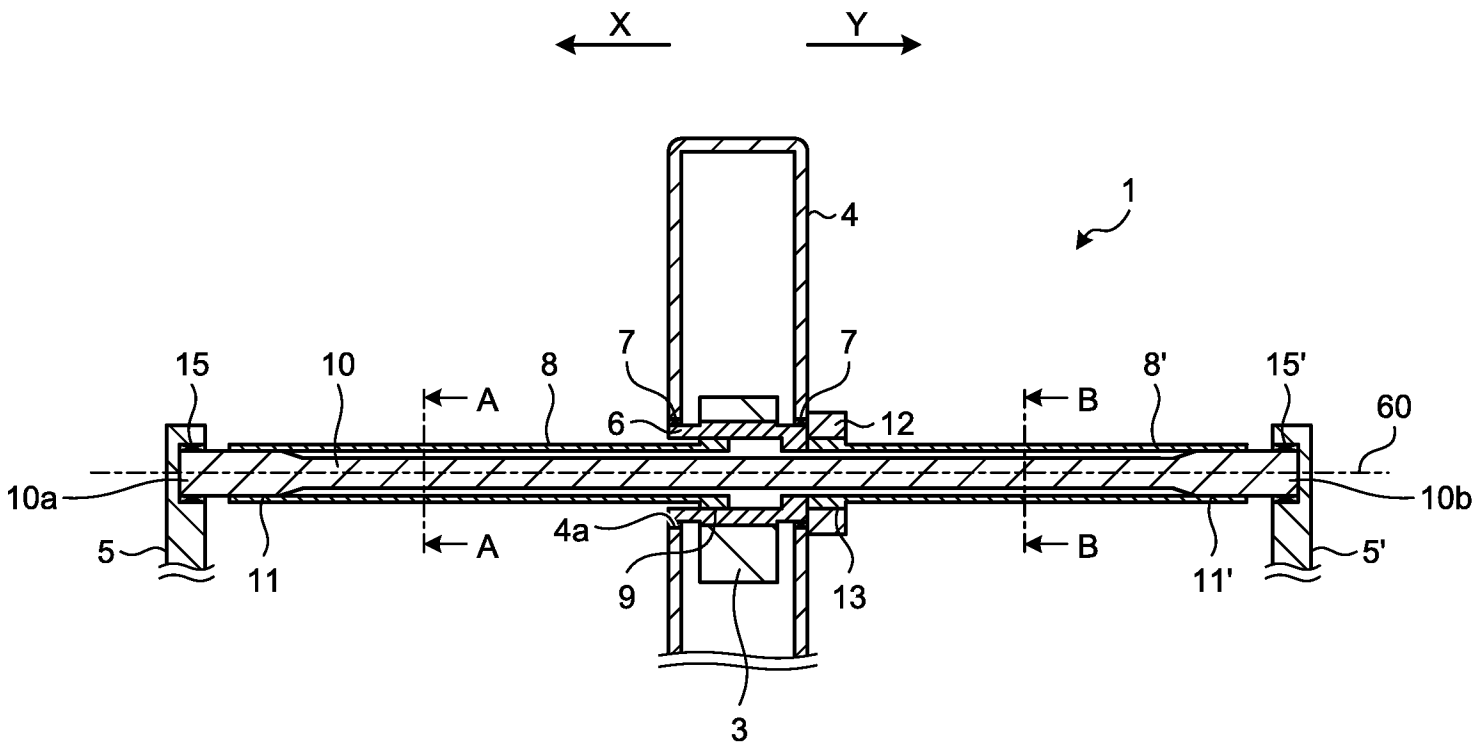
FIG. 2 is a front cross-sectional view of an opening torsion bar of the operating device according to the first embodiment.
Figure 3:
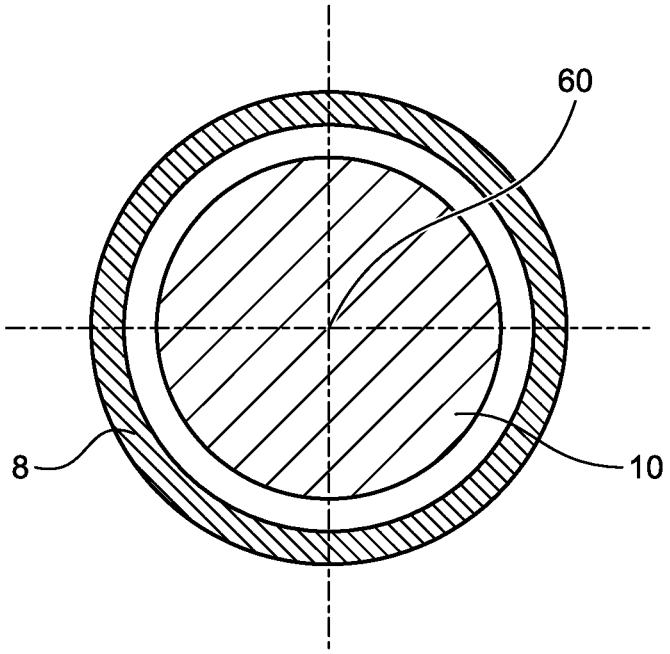
FIG. 3 is a cross-sectional view taken along line A-A illustrated in FIG. 2.
Figure 4:
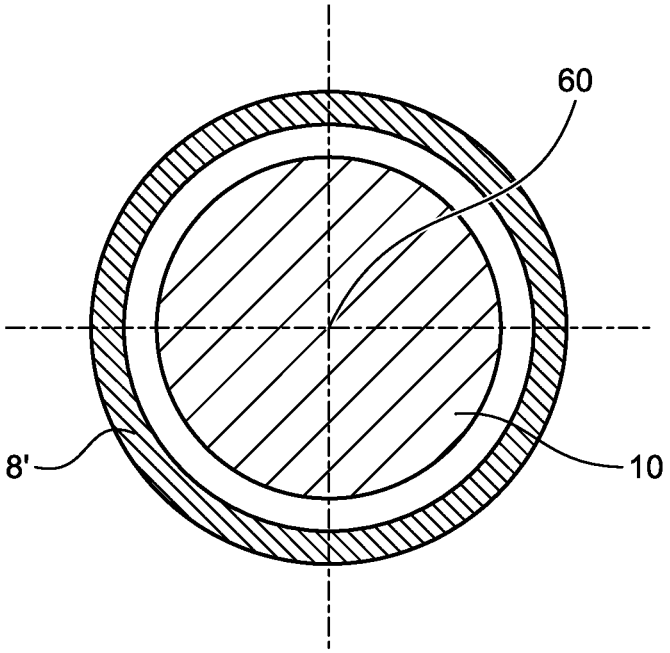
FIG. 4 is a cross-sectional view taken along line B-B illustrated in FIG. 2.

FIG. 2 is a front cross-sectional view of the opening torsion bar 1 of the operating device 52 according to the first embodiment. FIG. 3 is a cross-sectional view taken along line A-A illustrated in FIG. 2. FIG. 4 is a cross-sectional view taken along line B-B illustrated in FIG. 2. A through hole 4*a* penetrating along the direction indicated by arrow X is formed in the housing 4 of the operating device 52. An opening shaft 6 is supported in the through hole 4*a* via a bearing 7 so as to be rotatable about a rotating axis 60. The opening shaft 6 has a tubular shape including the rotating axis 60 as its central axis.

An output lever 3 is coupled to the opening shaft 6. The output lever 3 is rotatable about the rotating axis 60 together with the opening shaft 6. The output lever 3 is housed inside the housing 4. As illustrated in FIG. 1, the output lever 3 is coupled to a movable contact 56 via a link mechanism 55 provided inside the tank 51. As the output lever 3 rotates, the movable contact 56 moves. The movable contact 56 moves between a position where it is in contact with a fixed contact 57 provided in the tank 51 and a position where it is separate from the fixed contact 57. The movable contact 56 and the fixed contact 57 constitute a contact where they can be in and out of contact with each other.

A first torsion bar 8 is coupled to the opening shaft 6. Specifically, the opening shaft 6 and the first torsion bar 8 are coupled at a contact portion 9 where the inner peripheral face of the opening shaft 6 and the outer peripheral face of the first torsion bar 8 are in contact with each other. In other words, the output lever 3 and the first torsion bar 8 are coupled to each other via the opening shaft 6.

The first torsion bar 8 has a tubular shape including the rotating axis 60 as its central axis, and extends in the direction indicated by arrow X from the opening shaft 6. A second torsion bar 10 having a solid columnar shape is provided inside the first torsion bar 8. The second torsion bar 10 extends along the rotating axis 60.

The second torsion bar 10 is coupled to a portion of the first torsion bar 8 located farther in the direction indicated by arrow X than the output lever 3. In the first embodiment, the end of the first torsion bar 8 located in the direction indicated by arrow X is coupled to the second torsion bar 10 at a contact portion 11 where they are in contact with each other. The second torsion bar 10 protrudes toward the direction indicated by arrow X from the first torsion bar 8. One end 10*a*, which is the end of the second torsion bar 10 located in the direction indicated by arrow X, is supported by the first support 5 fixed to the tank 51.

The second torsion bar 10 passes through the through hole 4*a* formed in the housing 4 and extends toward the direction indicated by arrow Y opposite to the direction indicated by arrow X beyond the housing 4. The other end 10*b*, which is the end of the second torsion bar 10 located in the direction indicated by arrow Y, is supported by the second support 5' fixed to the tank 51. The second torsion bar 10 is supported by the first support 5 via a bearing 15 and is supported by the second support 5' via a bearing 15', so that the second torsion bar 10 can rotate about the rotating axis 60.

A third torsion bar 8' surrounding the second torsion bar 10 is provided farther in the direction indicated by arrow Y than the housing 4. The third torsion bar 8' has a tubular shape including the rotating axis 60 as its central axis. The third torsion bar 8' is coupled to the second torsion bar 10 at its end located in the direction indicated by arrow Y. In the first embodiment, the outer peripheral face of the second torsion bar 10 and the inner peripheral face of the third torsion bar 8' are coupled at a contact portion 11' where they are in contact with each other. The third torsion bar 8' is inserted into the recess formed in a fixing block 12 fixed to the housing 4 at its end located in the direction indicated by arrow X, and is coupled to the fixing block 12. In the first embodiment, the inner peripheral face of the recess of the fixing block 12 and the outer peripheral face of the third torsion bar 8' are coupled at a contact portion 13 where they are in contact with each other.

Each of the above-described contact portions 9, 11, 11', and 13 may have, for example, hexagonal or serration shapes that are engaged with each other, or may be a joined portion formed by welding or the like. With such a configuration, the opening shaft 6, the first torsion bar 8, the second torsion bar 10, and the third torsion bar 8' rotate synchronously at the contact portions 9, 11, and 11', and the rotation of the third torsion bar 8' is restricted at the contact portion 13.

In the opening torsion bar 1 of the operating device 52 described above, when the output lever 3, which is on the free end side, rotates about the rotating axis 60, the first torsion bar 8, the second torsion bar 10, and the third torsion bar 8' are twisted since the end of the third torsion bar 8' is a fixed end, so that the energy to return to the original state is stored. In the operating device 52, the first torsion bar 8, the second torsion bar 10, and the third torsion bar 8' are twisted to bring the movable contact 56 into contact with the fixed contact 57. Further, when the first torsion bar 8, the second torsion bar 10, and the third torsion bar 8' return from the twisted state to the original state, the movable contact 56 is separated from the fixed contact 57. Restricting the first torsion bar 8, the second torsion bar 10, and the third torsion bar 8' from returning from the twisted state to the original state by a latch mechanism (not illustrated) enables the movable contact 56 and the fixed contact 57 to maintain contact with each other. Releasing the restriction by the latch mechanism enables the first torsion bar 8, the second torsion bar 10, and the third torsion bar 8' to return from the twisted state to the original state, and enables the movable contact 56 to separate from the fixed contact 57. That is, the movable contact 56 can move at a high speed and separate from the fixed contact 57 by utilizing the energy stored by twisting.

Figure 5:
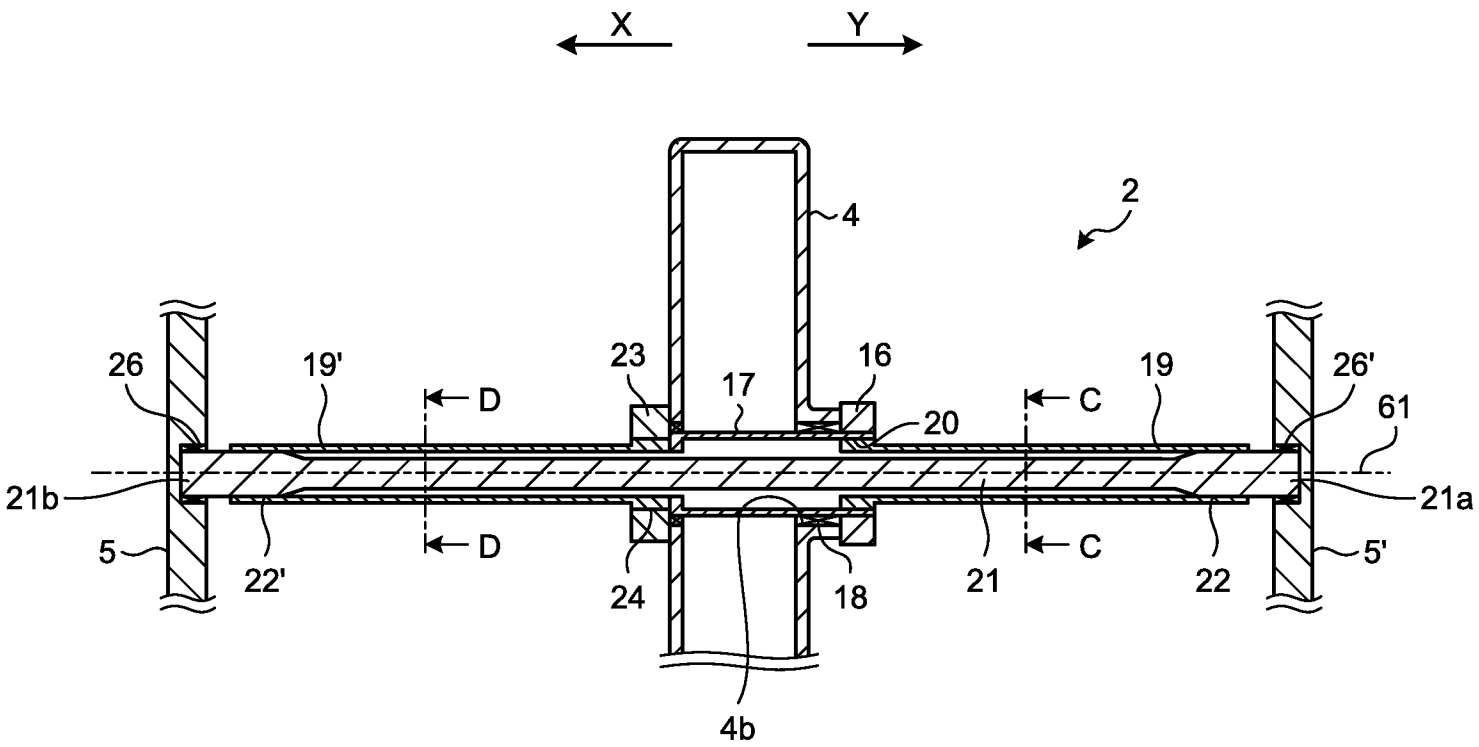
FIG. 5 is a front sectional view of a closing torsion bar of the operating device according to the first embodiment.
Figure 6:
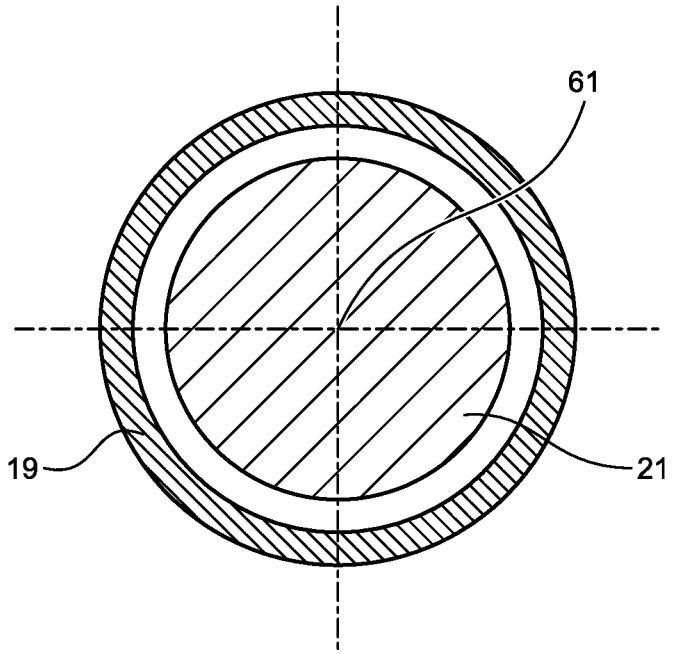
FIG. 6 is a cross-sectional view taken along line C-C illustrated in FIG. 5.
Figure 7:
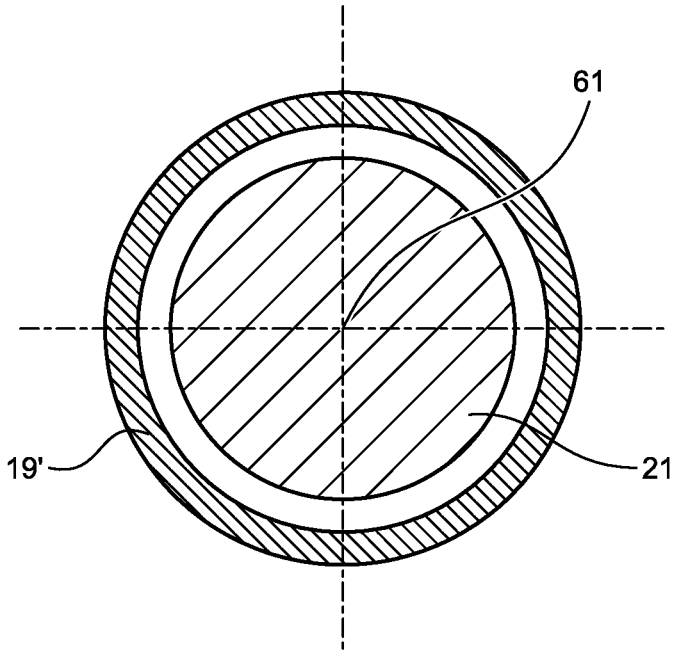
FIG. 7 is a cross-sectional view taken along line D-D illustrated in FIG. 5.

FIG. 5 is a front sectional view of the closing torsion bar 2 of the operating device 52 according to the first embodiment. FIG. 6 is a cross-sectional view taken along line C-C illustrated in FIG. 5. FIG. 7 is a cross-sectional view taken along line D-D illustrated in FIG. 5. A through hole 4*b* penetrating along the direction indicated by arrow X is formed in the housing 4 of the operating device 52. A closing shaft 17 is supported in the through hole 4*b* via a bearing 18 so as to be rotatable about a rotating axis 61. The closing shaft 17 has a tubular shape including the rotating axis 61 as its central axis.

A closing lever 16 is coupled to the closing shaft 17. The closing lever 16 is rotatable about the rotating axis 61 together with the closing shaft 17. A first torsion bar 19 is coupled to the closing shaft 17. Specifically, the closing shaft 17 and the first torsion bar 19 are coupled at a contact portion 20 where the inner peripheral face of the closing shaft 17 and the outer peripheral face of the first torsion bar 19 are in contact with each other. In other words, the closing lever 16 and the first torsion bar 19 are coupled to each other via the closing shaft 17.

The first torsion bar 19 has a tubular shape including the rotating axis 61 as its central axis. The first torsion bar 19 has a tubular shape extending in the direction indicated by arrow Y from the closing shaft 17. A second torsion bar 21 having a solid columnar shape is provided inside the first torsion bar 19. The second torsion bar 21 extends along the rotating axis 61. In the description of the closing torsion bar 2, the direction indicated by arrow X is the second direction, and the direction indicated by arrow Y is the first direction.

The second torsion bar 21 is coupled to a portion of the first torsion bar 19 located farther in the direction indicated by arrow Y than the closing lever 16. In the first embodiment, the end of the first torsion bar 19 located in the direction indicated by arrow Y is coupled to the second torsion bar 21 at a contact portion 22 where they are in contact with each other. The second torsion bar 21 protrudes toward the direction indicated by arrow Y from the first torsion bar 19. One end 21*a*, which is the end of the second torsion bar 21 located in the direction indicated by arrow Y, is supported by the second support 5' fixed to the tank 51.

The second torsion bar 21 passes through the through hole 4*b* formed in the housing 4 and extends toward the direction indicated by arrow X beyond the housing 4. The other end 21*b*, which is the end of the second torsion bar 21 located in the direction indicated by arrow X, is supported by the first support 5 fixed to the tank 51. The second torsion bar 21 is supported by the first support 5 via a bearing 26 and is supported by the second support 5' via a bearing 26', so that the second torsion bar 21 can rotate about the rotating axis 61.

A third torsion bar 19' surrounding the second torsion bar 21 is provided farther in the direction indicated by arrow X than the housing 4. The third torsion bar 19' has a tubular shape including the rotating axis 61 as its central axis. The third torsion bar 19' is coupled to the second torsion bar 21 at its end located in the direction indicated by arrow X. In the first embodiment, the second torsion bar 21 and the third torsion bar 19' are coupled at a contact portion 22' where the outer peripheral face of the second torsion bar 21 and the inner peripheral face of the third torsion bar 19' are in contact with each other. The third torsion bar 19' is inserted into the recess formed in a fixing block 23 fixed to the housing 4 at its end located in the direction indicated by arrow Y, and is coupled to the fixing block 23. In the first embodiment, the inner peripheral face of the recess of the fixing block 23 and the outer peripheral face of the third torsion bar 19' are coupled at a contact portion 24 where they are in contact with each other.

Each of the above-described contact portions 20, 22, 22', and 24 may have, for example, hexagonal or serration shapes that are engaged with each other, or may be a joined portion formed by welding or the like. With this configuration, the closing shaft 17, the first torsion bar 19, the second torsion bar 21, and the third torsion bar 19' rotate synchronously at the contact portions 20, 22, and 22', and the rotation of the third torsion bar 19' is restricted at the contact portion 24.

Figure 8:
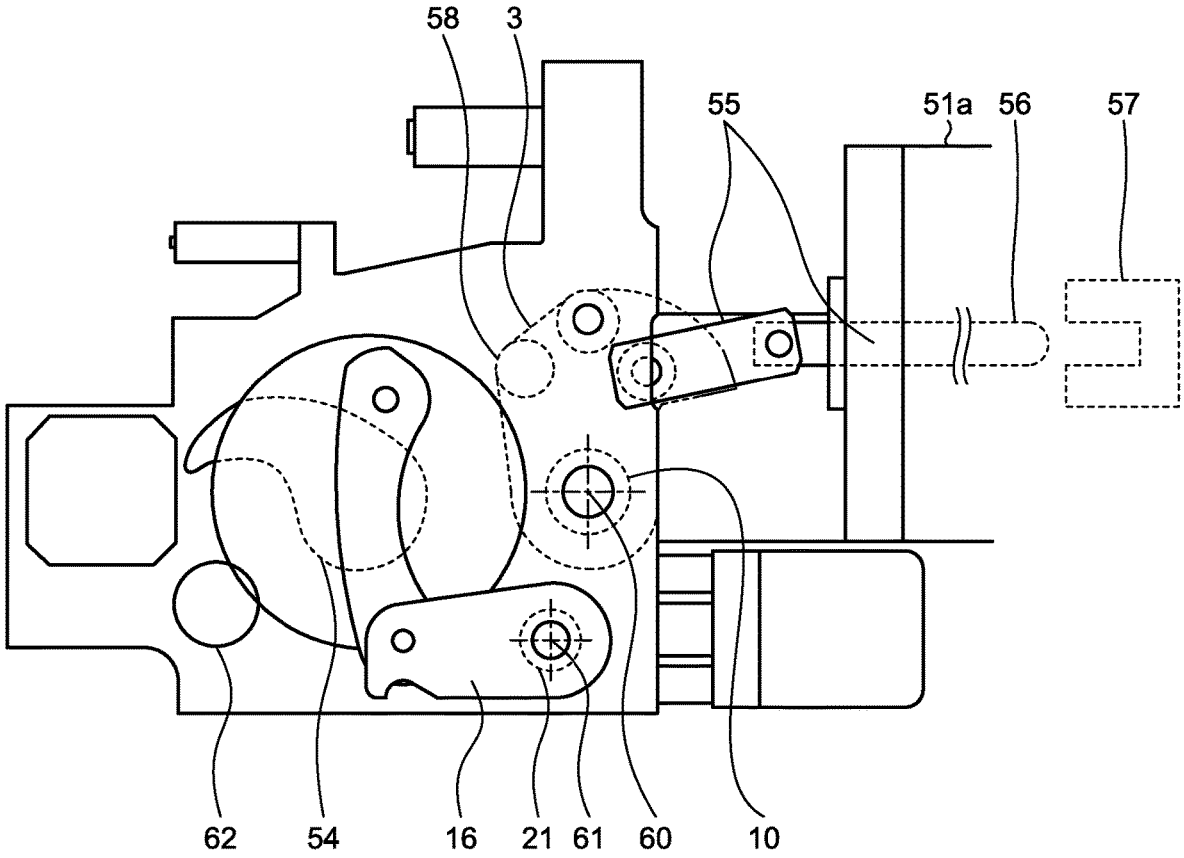
FIG. 8 is a side view of the operating device in the first embodiment.

FIG. 8 is a side view of the operating device 52 in the first embodiment. In the closing torsion bar 2 of the operating device 52, when the closing lever 16, which is on the free end side, rotates about the rotating axis 61, the first torsion bar 19, the second torsion bar 21, and the third torsion bar 19' are twisted since the end of the third torsion bar 19' is a fixed end, so that the energy to return to the original state is stored. A cam 54 of the operating device 52 is configured to press an abutting portion 58 of the output lever 3 to rotate the output lever 3 while the first torsion bar 19, the second torsion bar 21, and the third torsion bar 19' are returning from the twisted state. Restricting the first torsion bar 19, the second torsion bar 21, and the third torsion bar 19' from returning from the twisted state to the original state by a latch mechanism (not illustrated) enables the movable contact 56 to maintain a distance from the fixed contact 57. Releasing the restriction by the latch mechanism enables the first torsion bar 19, the second torsion bar 21, and the third torsion bar 19' to return from the twisted state to the original state, and enables the cam 54 to rotate the output lever 3, so that the movable contact 56 can be brought into contact with the fixed contact 57. That is, the movable contact 56 can move at a high speed and come into contact with the fixed contact 57 by utilizing the energy stored by twisting.

When the output lever 3 pressed into the cam 54 rotates, the first torsion bar 8, the second torsion bar 10, and the third torsion bar 8' of the opening torsion bar 1 are twisted to accumulate energy. Here, restricting the first torsion bar 8, the second torsion bar 10, and the third torsion bar 8' from returning from the twisted state by the latch mechanism enables the movable contact 56 and the fixed contact 57 to maintain contact with each other. Thereafter, the first torsion bar 19, the second torsion bar 21, and the third torsion bar 19' are twisted with a motor 62, whereby the cam 54 is moved, and energy can be stored in the first torsion bar 19, the second torsion bar 21, and the third torsion bar 19'.

Since the opening torsion bar 1 and the closing torsion bar 2 extend both in the direction indicated by arrow X and in the direction indicated by arrow Y across the housing 4, it is possible to reduce the protruding area of the opening torsion bar 1 and the closing torsion bar 2 from the tank 51 as compared with the case of extending them only in one direction. In the first embodiment, as illustrated in FIG. 1, the opening torsion bar 1 and the closing torsion bar 2 do not protrude from the tank 51 as viewed in the direction perpendicular to the end face 51*a* of the tank 51. This makes it possible to shorten the distance from the levers coupled to the contact to the ends of the torsion bars, reduce the size of the circuit breaker 50, and simplify the support structure for supporting the opening torsion bar 1 and the closing torsion bar 2.

Figure 9:
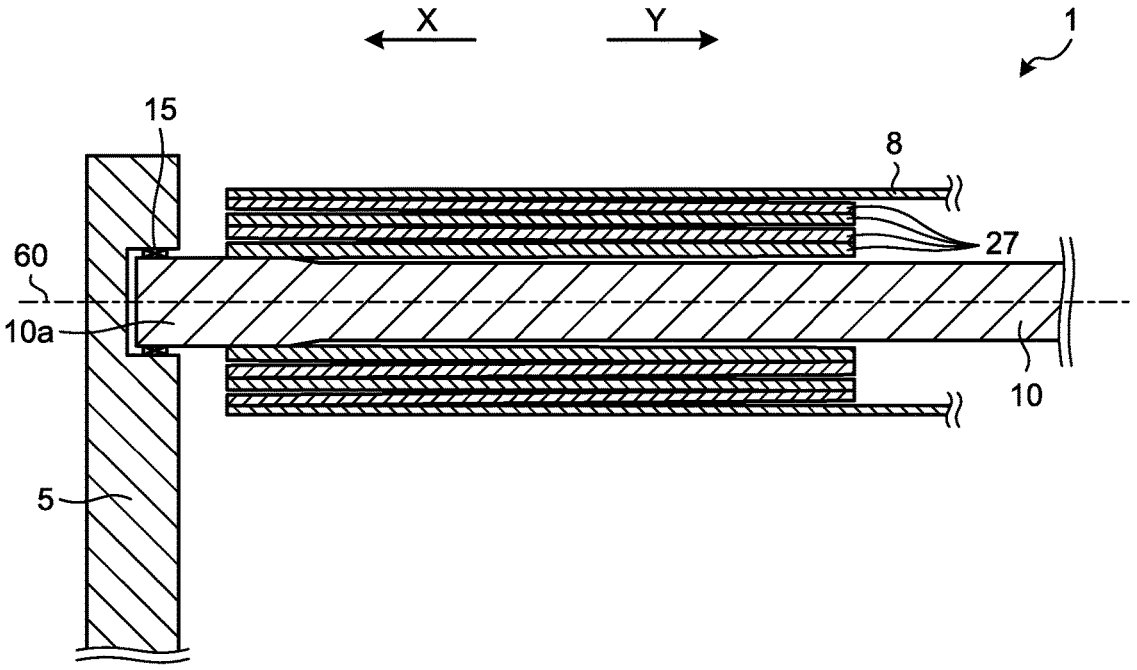
FIG. 9 is a cross-sectional view of the opening torsion bar of the circuit breaker according to a first modification of the first embodiment, in which the section around a first support is enlarged.
Figure 10:
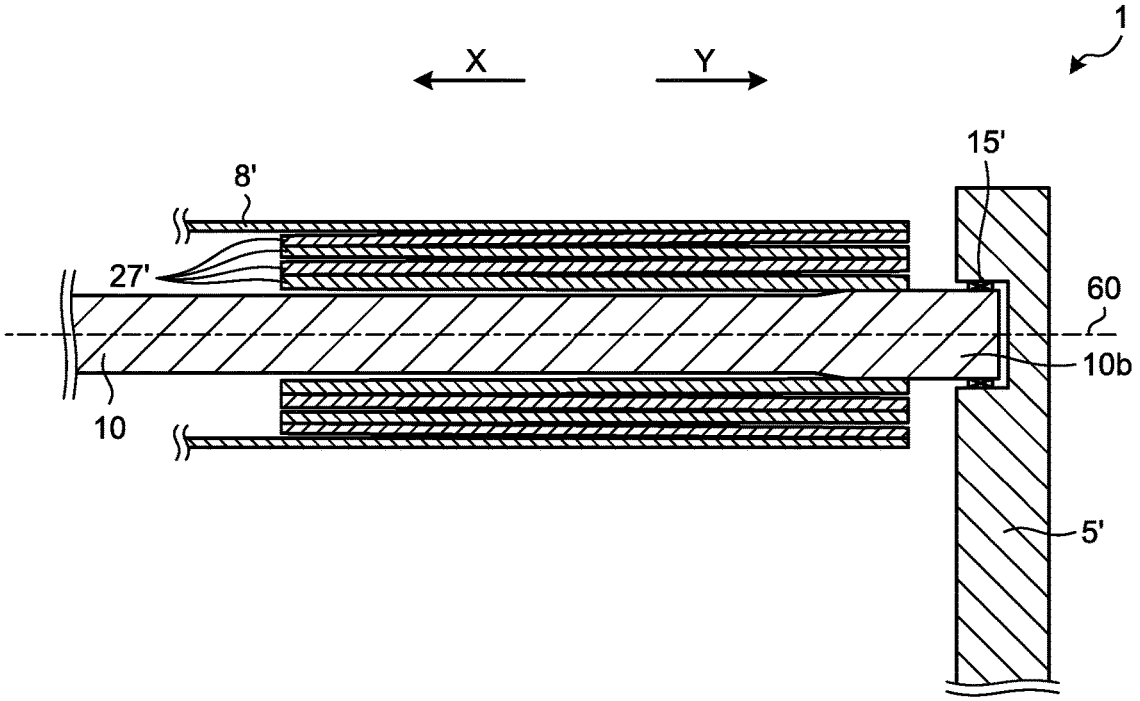
FIG. 10 is a cross-sectional view of the opening torsion bar of the circuit breaker according to the first modification of the first embodiment, in which the section around a second support is enlarged.

FIG. 9 is a cross-sectional view of the opening torsion bar 1 of the circuit breaker according to a first modification of the first embodiment, in which the section around the first support 5 is enlarged. FIG. 10 is a cross-sectional view of the opening torsion bar 1 of the circuit breaker according to the first modification of the first embodiment, in which the section around the second support 5' is enlarged.

In the opening torsion bar 1 according to the first modification, as illustrated in FIG. 9, a plurality of first intermediate coupling bars 27 each having a cylindrical shape is provided concentrically between the first torsion bar 8 and the second torsion bar 10. The first torsion bar 8 and the second torsion bar 10 are coupled via the first intermediate coupling bars 27. More specifically, each of the first intermediate coupling bars 27 is coupled on one end side to the second torsion bar 10 or another first intermediate coupling bar 27 disposed inside the first intermediate coupling bar 27, and is coupled on the other end side to the first torsion bar 8 or another first intermediate coupling bar 27 disposed outside the first intermediate coupling bar 27.

Each of the plurality of first intermediate coupling bars 27 may be formed with the same plate thickness. Alternatively, outer first intermediate coupling bars 27 may be thinner than inner first intermediate coupling bars 27 as illustrated in FIG. 9. By reducing the thickness of outer first intermediate coupling bars 27 in this manner, the secondary polar moment of area of the plurality of first intermediate coupling bars 27 is equalized, and the twisting stress can be equalized when the first intermediate coupling bars 27 are twisted. As a result, it is possible to suppress an increase in the size of the opening torsion bar 1.

In the opening torsion bar 1 according to the first modification, as illustrated in FIG. 10, a plurality of second intermediate coupling bars 27' each having a cylindrical shape is provided concentrically between the third torsion bar 8' and the second torsion bar 10. The third torsion bar 8' and the second torsion bar 10 are coupled via the second intermediate coupling bars 27'. More specifically, each of the second intermediate coupling bars 27' is coupled on one end side to the second torsion bar 10 or another second intermediate coupling bar 27' disposed inside the second intermediate coupling bar 27', and is coupled on the other end side to the third torsion bar 8' or another second intermediate coupling bar 27' disposed outside the second intermediate coupling bar 27'.

Each of the plurality of second intermediate coupling bars 27' may be formed with the same plate thickness. Alternatively, outer second intermediate coupling bars 27' may be thinner than inner second intermediate coupling bars 27' as illustrated in FIG. 10. By reducing the thickness of outer second intermediate coupling bars 27' in this manner, the secondary polar moment of area of the plurality of second intermediate coupling bars 27' is equalized, and the twisting stress can be equalized when the second intermediate coupling bars 27' are twisted. As a result, it is possible to suppress an increase in the size of the opening torsion bar 1. By using the plurality of first intermediate coupling bars 27 and the plurality of second intermediate coupling bars 27', it is possible to shorten the total length of the opening torsion bar 1.

The same effect can be obtained by providing such intermediate coupling bars in the closing torsion bar 2. Alternatively, only one of the first intermediate coupling bars 27 and the second intermediate coupling bars 27' may be provided.

Second Embodiment

Figure 11:
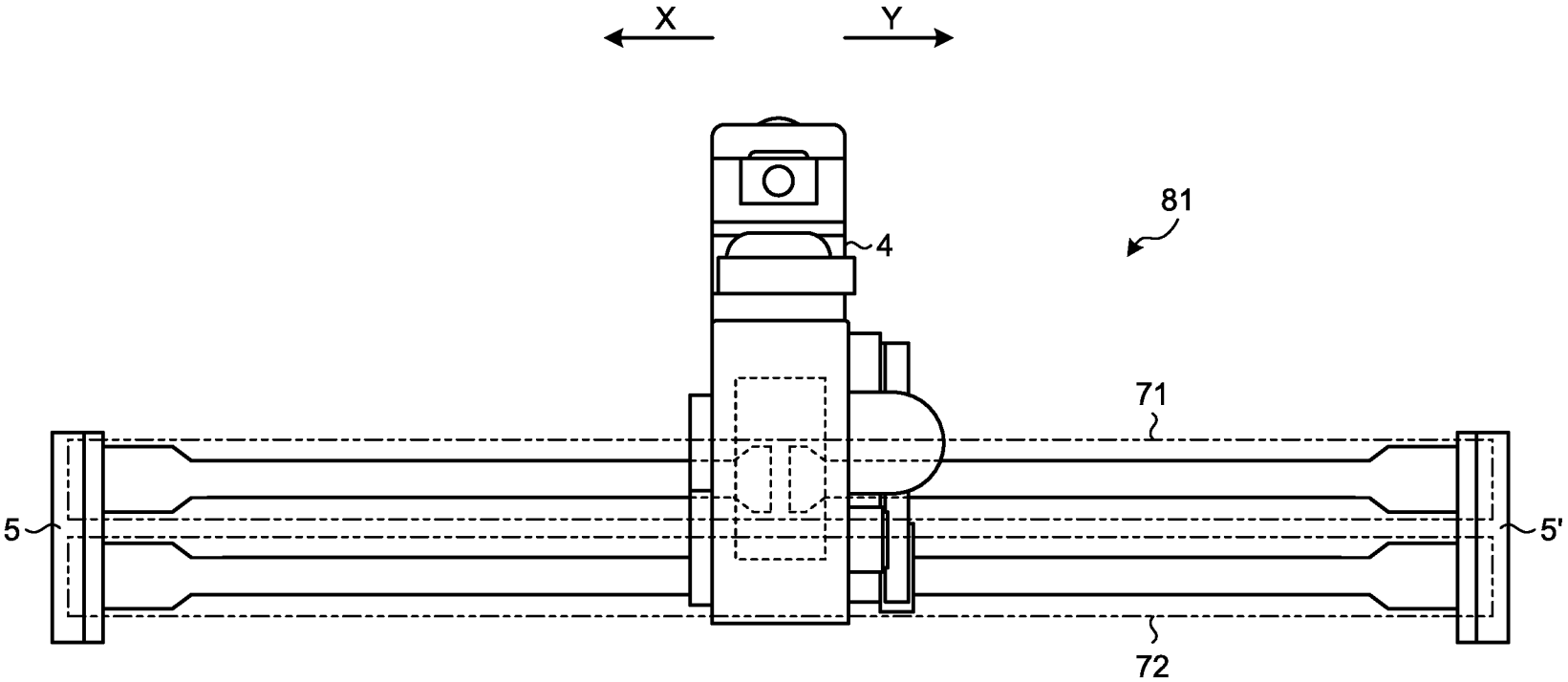
FIG. 11 is a front view of an operating device of a circuit breaker according to a second embodiment of the present invention.
Figure 12:
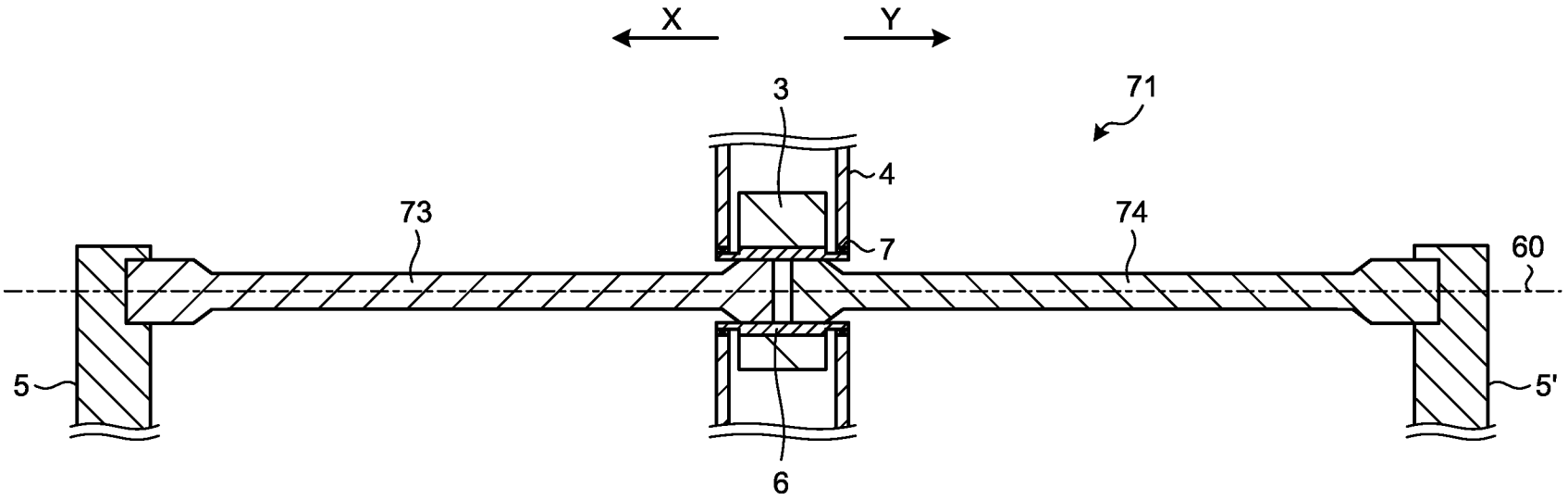
FIG. 12 is a cross-sectional view of an opening torsion bar in the second embodiment as viewed from the front.
Figure 13:
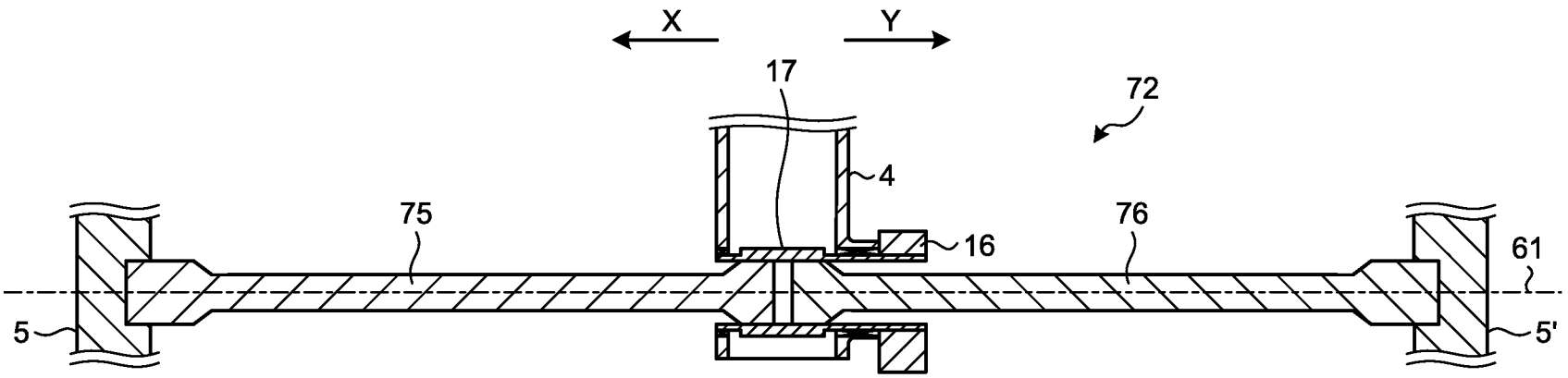
FIG. 13 is a cross-sectional view of a closing torsion bar in the second embodiment as viewed from the front.

FIG. 11 is a front view of an operating device 81 of a circuit breaker according to a second embodiment of the present invention. FIG. 12 is a cross-sectional view of an opening torsion bar 71 in the second embodiment as viewed from the front. FIG. 13 is a cross-sectional view of a closing torsion bar 72 in the second embodiment as viewed from the front. Note that components similar to those of the first embodiment are denoted by the same reference signs, and a detailed description thereof is omitted.

In the operating device 81 according to the second embodiment, as illustrated in FIGS. 11 and 12, the opening torsion bar 71 is coupled to the output lever 3, and includes a first torsion bar 73 extending in the direction indicated by arrow X along the rotating axis 60 and a second torsion bar 74 extending in the direction indicated by arrow Y along the rotating axis 60. The first torsion bar 73 and the second torsion bar 74 are coupled to the output lever 3 via the opening shaft 6. The contact portion where the first torsion bar 73 and the second torsion bar 74 are coupled to the output lever 3 may have serration or hexagonal shapes, or may be a joined portion formed by welding or the like.

The end of the first torsion bar 73 located in the direction indicated by arrow X is fixed and supported by the first support 5. For example, the end of the first torsion bar 73 is inserted into the recess formed in the first support 5, and the contact portion between the first torsion bar 73 and the first support 5 may have serration or hexagonal shapes, or may be a joined portion formed by welding or the like.

The end of the second torsion bar 74 located in the direction indicated by arrow Y is fixed and supported by the second support 5'. For example, the end of the second torsion bar 74 is inserted into the recess formed in the second support 5', and the contact portion between the second torsion bar 74 and the second support 5' may have serration or hexagonal shapes, or may be a joined portion formed by welding or the like.

As illustrated in FIGS. 11 and 13, the closing torsion bar 72 is coupled to the closing lever 16, and includes a first torsion bar 75 extending in the direction indicated by arrow X along the rotating axis 61 and a second torsion bar 76 extending in the direction indicated by arrow Y along the rotating axis 61. The first torsion bar 75 and the second torsion bar 76 are coupled to the closing lever 16 via the closing shaft 17. The contact portion where the first torsion bar 75 and the second torsion bar 76 are coupled to the closing lever 16 may have serration or hexagonal shapes, or may be a joined portion formed by welding or the like.

The end of the first torsion bar 75 located in the direction indicated by arrow X is fixed and supported by the first support 5. For example, the end of the first torsion bar 75 is inserted into the recess formed in the first support 5, and the contact portion between the first torsion bar 75 and the first support 5 may have serration or hexagonal shapes, or may be a joined portion formed by welding or the like.

The end of the second torsion bar 76 located in the direction indicated by arrow Y is fixed and supported by the second support 5'. For example, the end of the second torsion bar 76 is inserted into the recess formed in the second support 5', and the contact portion between the second torsion bar 76 and the second support 5' may have serration or hexagonal shapes, or may be a joined portion formed by welding or the like.

In the operating device 81 described above, the opening torsion bar 71 and the closing torsion bar 72 extend both in the direction indicated by arrow X and in the direction indicated by arrow Y across the housing 4. Therefore, it is possible to reduce the protruding area of the opening torsion bar 71 and the closing torsion bar 72 from the tank 51 as compared with the case of extending them only in one direction. In the second embodiment, the opening torsion bar 71 and the closing torsion bar 72 do not protrude from the tank 51 as viewed in the direction perpendicular to the end face 51*a* (see also FIG. 1) of the tank 51. This makes it possible to shorten the distance from the levers 3 and 16 coupled to the contact to the ends of the torsion bars 71 and 72, reduce the size of the circuit breaker, and simplify the support structure for supporting the opening torsion bar 71 and the closing torsion bar 72.

In addition, as in the first embodiment, it is possible to speed up the opening and closing operation for the contact by utilizing the energy stored when the opening torsion bar 71 and the closing torsion bar 72 are twisted. The first support 5 and the second support 5' for the torsion bars illustrated in the first and second embodiments can be omitted, for example, if the torsion bars have low output energy according to specifications and are lightweight.

The configuration described in the above-mentioned embodiments indicates an example of the contents of the present invention. The configuration can be combined with another well-known technique, and a part of the configuration can be omitted or changed in a range not departing from the gist of the present invention.

REFERENCE SIGNS LIST

1 opening torsion bar; 2 closing torsion bar; 3 output lever; 4 housing; 4*a* through hole; 4*b* through hole; 5 first support; 5' second support; 6 opening shaft; 7 bearing; 8 first torsion bar; 8' third torsion bar; 9 contact portion; 10 second torsion bar; 10*a* one end; 10*b* other end; 11, 11' contact portion; 12 fixing block; 13 contact portion; 15, 15' bearing; 16 closing lever; 17 closing shaft; 18 bearing; 19 first torsion bar; 19' third torsion bar; 20 contact portion; 21 second torsion bar; 21*a* one end; 21*b* other end; 22, 22' contact portion; 23 fixing block; 24 contact portion; 26, 26' bearing; 27 first intermediate coupling bar; 27' second intermediate coupling bar; 50 circuit breaker; 51 tank; 51*a* end face; 52 operating device; 54 cam; 55 link mechanism; 56 movable contact; 57 fixed contact; 58 abutting portion; 60, 61 rotating axis; 71 opening torsion bar; 72 closing torsion bar; 73, 75 first torsion bar; 74, 76 second torsion bar; 81 operating device.

The invention claimed is:

1. An operating device comprising:

a lever rotatable about a rotating axis;

a first torsion bar coupled to the lever, having a tubular shape including the rotating axis as its central axis, and extending in a first direction along the rotating axis;

a second torsion bar provided inside the first torsion bar, extending along the rotating axis, coupled to the first torsion bar at a portion located farther in the first direction than the lever, and extending from the portion of coupling with the first torsion bar toward a second direction opposite to the first direction beyond the lever; and a third torsion bar surrounding the second torsion bar, having a tubular shape including the rotating axis as its center, coupled to the second torsion bar at a portion located farther in the second direction than the lever, and extending from the portion of coupling with the second torsion bar in the first direction, wherein rotation of the third torsion bar is restricted at its end located in the first direction.

2. The operating device according to claim 1, further comprising:

a first supporter to rotatably support the second torsion bar at one end that is an end located in the first direction; and a second supporter to rotatably support the second torsion bar at the other end that is an end located in the second direction.

3. The operating device according to claim 1, wherein the second torsion bar has a solid columnar shape.

4. The operating device according to claim 1, further comprising a plurality of intermediate coupling bars each having a cylindrical shape and concentrically provided between the second torsion bar and the third torsion bar, wherein one of the intermediate coupling bars is coupled on one end side to the second torsion bar disposed inside the intermediate coupling bar, and is coupled on the other end side to the third torsion bar or another intermediate coupling bar disposed outside the intermediate coupling bar, and thus the second torsion bar and the third torsion bar are coupled to each other via the intermediate coupling bars.

5. The operating device according to claim 4, wherein outer intermediate coupling bars of the plurality of intermediate coupling bars are thinner than inner intermediate coupling bars of the plurality of intermediate coupling bars.

6. The operating device according to claim 1, further comprising a plurality of intermediate coupling bars each having a cylindrical shape and concentrically provided between the second torsion bar and the first torsion bar, wherein one of the intermediate coupling bars is coupled on one end side to the second torsion bar disposed inside the intermediate coupling bar, and is coupled on the other end side to the first torsion bar or another intermediate coupling bar disposed outside the intermediate coupling bar, and thus the second torsion bar and the first torsion bar are coupled to each other via the intermediate coupling bars.

7. The operating device according to claim 6, wherein outer intermediate coupling bars of the plurality of intermediate coupling bars are thinner than inner intermediate coupling bars of the plurality of intermediate coupling bars.

8. A circuit breaker comprising:

the operating device according to claim 1;

a movable contactor to move in conjunction with rotation of the lever; and a fixed contactor provided at a position where the movable contactor is able to be brought into contact with or separated from the fixed contactor as the movable contactor moves.

9. A circuit breaker comprising:

the operating device according to claim 2;

a movable contactor to move in conjunction with rotation of the lever; and a fixed contactor provided at a position where the movable contactor is able to be brought into contact with or separated from the fixed contactor as the movable contactor moves.

10. A circuit breaker comprising:

the operating device according to claim 3;

a movable contactor to move in conjunction with rotation of the lever; and a fixed contactor provided at a position where the movable contactor is able to be brought into contact with or separated from the fixed contactor as the movable contactor moves.

11. A circuit breaker comprising:

the operating device according to claim 4;

a movable contactor to move in conjunction with rotation of the lever; and a fixed contactor provided at a position where the movable contactor is able to be brought into contact with or separated from the fixed contactor as the movable contactor moves.

12. A circuit breaker comprising:

the operating device according to claim 5;

a movable contactor to move in conjunction with rotation of the lever; and a fixed contactor provided at a position where the movable contactor is able to be brought into contact with or separated from the fixed contactor as the movable contactor moves.

13. A circuit breaker comprising:

the operating device according to claim 6;

a movable contactor to move in conjunction with rotation of the lever; and a fixed contactor provided at a position where the movable contactor is able to be brought into contact with or separated from the fixed contactor as the movable contactor moves.

14. A circuit breaker comprising:

the operating device according to claim 7;

a movable contactor to move in conjunction with rotation of the lever; and a fixed contactor provided at a position where the movable contactor is able to be brought into contact with or separated from the fixed contactor as the movable contactor moves.

15. The operating device according to claim 1, wherein the device is configured such that torque from the lever is transmitted to the third torsion bar via the first torsion bar and the second torsion bar.

* * * * *